US005699756A

United States Patent [19]

Ross et al.

[11] Patent Number: 5,699,756

[45] Date of Patent: Dec. 23, 1997

[54] WET-BASE, DOWN-FIRED WATER HEATER

[75] Inventors: David O. Ross, Montgomery; Dale A. Southerland, Eclectic; Timothy D. Gantt, Pike Road, all of Ala.

[73] Assignee: Rheem Manufacturing Co., New York, N.Y.

[21] Appl. No.: 727,258

[22] Filed: Oct. 8, 1996

[51] Int. Cl.[6] ..... F22B 5/00

[52] U.S. Cl. ..... 122/17; 122/13.1; 122/14; 122/161

[58] Field of Search ..... 122/13.1, 14, 16, 122/17, 135.1, 157, 158, 160, 161, 162, 49

[56] References Cited

U.S. PATENT DOCUMENTS

| | | | |
|---|---|---|---|
| 3,724,447 | 4/1973 | Parkhill et al. | 126/360 R |
| 4,329,943 | 5/1982 | Schwörer | 122/17 |
| 4,380,215 | 4/1983 | Mendelson | 122/13 |
| 4,445,464 | 5/1984 | Gerstmann et al. | 122/16 |
| 4,492,185 | 1/1985 | Kendall et al. | 122/32 |
| 4,541,410 | 9/1985 | Jatana | 126/362 |
| 4,651,714 | 3/1987 | Granberg | 126/378 |
| 4,685,425 | 8/1987 | Eising | 122/17 |
| 4,699,122 | 10/1987 | Jannemann et al. | 126/362 |
| 5,027,749 | 7/1991 | Cifaldi | 122/14 |
| 5,197,415 | 3/1993 | Stretch et al. | 122/17 |

*Primary Examiner*—Henry A. Bennett
*Assistant Examiner*—Jiping Lu
*Attorney, Agent, or Firm*—Konneker & Smith, P.C.

[57] ABSTRACT

A fuel-fired, forced draft, down-fired water heater is provided with an improved combustion product flow path that permits the heater to operate with improved fuel efficiency, lowered CO and NOx emissions, and an improved water heat input distribution along the vertical length of the heater. The water heater includes a vertically oriented tank with a vent plenum structure formed at the top end of the tank interior and having an outlet passage connectable to an external combustion product vent pipe. A centrally positioned submerged vertical burner tube extends downwardly from the vent plenum and has an open lower end extending into a submerged turn bowl disposed at the bottom end of the tank interior. Extending upwardly from the turn bowl within the tank interior, and symmetrically arranged about the centrally disposed burner tube, are a plurality of vertical flue tubes that communicate the interiors of the turn bowl and the vent plenum. A suitable fuel burner is disposed within the burner tube and is supplied with a throughflow of a pressurized fuel/air mixture which is ignited to create a downwardly directed flame and associated hot combustion products. During operation of the water heater, the hot combustion products are sequentially flowed downwardly through the burner tube into the submerged turn bowl, upwardly through the flue tubes into the vent plenum, and then outwardly through the vent plenum outlet passage.

5 Claims, 2 Drawing Sheets

WET-BASE, DOWN-FIRED WATER HEATER

BACKGROUND OF THE INVENTION

The present invention relates generally to fuel-fired heating equipment, and more particularly relates to fuel-fired water heaters.

Conventionally constructed fuel-fired water heaters are typically of a one pass, up-fired configuration in which a fuel burner is disposed at the bottom end of the heater water storage tank beneath a tube sheet to which vertical heat transfer tubes are connected. These tubes extend vertically through the water in the interior of the tank, and are appropriately connected at their upper ends to an external combustion product vent pipe. During water heater firing, the hot combustion products generated by the fuel burner make a single upward pass through the vertical tubes, thereby transferring combustion heat to the tank water, before being discharged into the external vent pipe.

This conventional up-fired water heater construction, though widely accepted and utilized over the years, is subject to a variety of well known problems, limitations and disadvantages. For example, particularly where "hard" water is being heated, it tends to create scaling, and resulting hot spots, on the tube sheet and heat transfer tubes which leads to premature tube sheet and/or tube burnout.

Additionally, the one vertical pass of hot combustion gases through the heat transfer tubes typically results in a relatively low combustion efficiency, leading to relatively high CO and NOx emission levels and correspondingly low fuel efficiency. Moreover, the high concentration of burner input at the lower end of the water heater tank is undesirable because during periods of high water drawdown (usually from the top of the tank) there tends to be a substantial undesirable temperature gradient between the water in the top portion of the tank and the water in the bottom portion of the tank.

A previously proposed solution to these problems, limitations and disadvantages typically associated with conventional single pass water heaters of the type generally described above is the two pass down-fired water heater shown in U.S. Pat. No. 5,197,415 to Stretch et al. In the Stretch et al fuel-fired water heater, a vertically oriented water storage tank is provided at its upper end with a vent plenum, and at its lower end with a submerged hollow turn bowl which is spaced downwardly apart from the vent plenum along the central vertical axis of the tank.

A vertically oriented burner tube is horizontally offset from the tank axis and has a closed upper end extending upwardly through the vent plenum, and an open lower end extending into and communicating with the interior of the turn bowl. Eight smaller diameter vertical flue tubes are grouped predominantly on an opposite side of the tank axis and have open upper and lower ends respectively extending into the vent plenum and the turn bowl to thereby communicate the interiors of the vent plenum and the turn bowl through the flue tubes.

During firing of the water heater, a fuel/air mixture is forced into a specially designed, vertically elongated perforated conical burner structure extending downwardly through an upper end portion of the burner tube, and ignited to form a flame and resulting hot combustion products within the burner tube. The hot combustion products discharged from the conical burner are sequentially flowed downwardly through the burner tube into the submerged turn bowl, upwardly through the eight flue tubes in a second combustion heating "pass" into the vent plenum, and then outwardly through a vent plenum outlet passage formed in a metal top pan structure forming the top side wall of the vent plenum.

Compared to conventional single pass water heaters, this down-fired two-pass design provided improved fuel efficiency, lowered NOx emissions, and an improved water heat input distribution along the vertical length of the heater. However, this previously proposed down-fired water heater had several problems, limitations and disadvantages of its own.

For example, during the design of this previously proposed down-fired water heater it was deemed necessary to provide it with the aforementioned asymmetrical burner tube/flue tube geometry (in which the burner tube was horizontally offset from the tank axis and positioned generally on an opposite side thereof from the plurality of smaller diameter flue tubes) in order to provide on the top pan portion of the water heater a combustion product discharge opening location that did not directly overlie any of the open upper ends of the flue tubes, to thereby prevent undesirable "short circuiting" of the exhausts of one or more of such tubes.

Various design compromises flowed from this asymmetrical burner tube/flue tube placement scheme, such as the need to strengthen the underlying structure that supported the tubes in order to compensate both for their unbalanced circumferential weight distribution and for the unbalanced water pressure distribution on the turn bowl, and to similarly strengthen the turn bowl structure due to combustion gas pressure imbalances therein. Further, the geometry of the water heater's heat transfer apparatus undesirably added to the fabrication complexity, and thus the production cost, of the finished water heater.

Additionally, to a large extent the various operational improvements provided by this previously proposed down-fired water flowed from its incorporation of a specially designed vertically elongated perforated conical burner disposed within an extended upper portion of its offset burner tube. This specially designed burner was relatively expensive to manufacture, and thus undesirably added even more to the overall production cost of the water heater.

Moreover, while compared to fuel-fired single pass water heaters the down-fired water heater provided improved vertical heat distribution within the tank, it created an undesirable horizontally circumferential variation in such heat input. This resulted in an undesirable substantial variation in the operating temperatures of the flue tubes.

It is accordingly an object of the present invention to provide a wet-base, down-fired water heater which provides the general advantages of the water heater illustrated and described in the aforementioned U.S. Pat. No. 5,197,415 yet eliminates or at least substantially reduces the above-mentioned problems, limitations and disadvantages associated therewith.

SUMMARY OF THE INVENTION

In carrying out principles of the present invention, in accordance with a preferred embodiment thereof, a wet-base, down-fired water heater is provided which incorporates therein substantial improvements over the wet-base, down-fired water heater illustrated and described in U.S. Pat. No. 5,197,415.

The improved water heater of the present invention, in a preferred embodiment thereof, has a vertical tank centered about a vertical axis and having an internal chamber adapted to hold a quantity of water. The tank has a top end, a bottom end, an inlet for receiving pressurized water to be heated within the internal chamber, and an outlet for discharging pressurized heated water from the internal chamber.

A vent plenum structure is formed within a top end portion of the tank and defined a top end boundary of the internal chamber. The vent plenum structure has an outlet passage extending outwardly through the tank and connectable to an external combustion product vent pipe. Disposed within a lower end portion of the internal chamber is an enclosed, hollow turn bowl structure, the turn bowl structure being centered about the vertical tank axis and having top and bottom side walls.

According to a key aspect of the present invention, the combustion heat transfer portion of the improved water heater has a symmetrical configuration in which a vertically oriented burner tube extends through the internal chamber along the vertical tank axis and has an upper end positioned adjacent the top end of the tank, and a lower end portion extending downwardly through the top side wall of the turn bowl structure and opening into the interior of the turn bowl structure. Forming another portion of the water heater combustion heat transfer portion are a plurality of vertically oriented flue tubes extending through the internal chamber in a symmetrically spaced array extending outwardly around and centered about the burner tube.

The flue tubes, which are preferably arranged in a circular array around the centered burner tube and have equal circumferential spacing between each circumferentially adjacent pair of flue tubes, have open upper end portions extending through the underside of the vent plenum structure, and opening into the interior of the vent plenum structure, and open lower end portions extending through the top side wall of the turn bowl structure and opening into the interior of the turn bowl structure. Each of the flue tubes, the central burner tube, and the turn bowl, during operation of the improved water heater, are submerged in and in intimate heat transfer contact with the water within the internal chamber of the tank.

Fuel/air delivery means are provided for flowing a pressurized fuel/air mixture into burner means that extend downwardly through an upper end portion of the burner tube. The burner means are operative to ignite the received fuel/air mixture to form hot combustion products which are sequentially flowed downwardly through the central burner tube into the turn bowl structure, upwardly through the flue tubes into the vent plenum structure, and then outwardly through the outlet passage of the vent plenum structure.

Preferably, the bottom end of the tank is defined by an upwardly domed bottom head structure, the turn bowl structure is supported atop the bottom head structure by a vertically oriented hollow cylindrical support column centered about the vertical tank axis, and the improved water heater further includes a condensate drain tube centrally extending downwardly from the turn bowl structure through the interior of the support column into the bottom head structure and having an interior communicating with the interior of the hollow turn bowl structure.

In the preferred embodiment thereof, the improved water heater of the present invention also includes sealed first and second handhole access openings extending horizontally through the tank and respectively positioned vertically adjacent the top side of the turn bowl structure and the top side of the bottom head structure.

DETAILED DESCRIPTION

Figure 1:
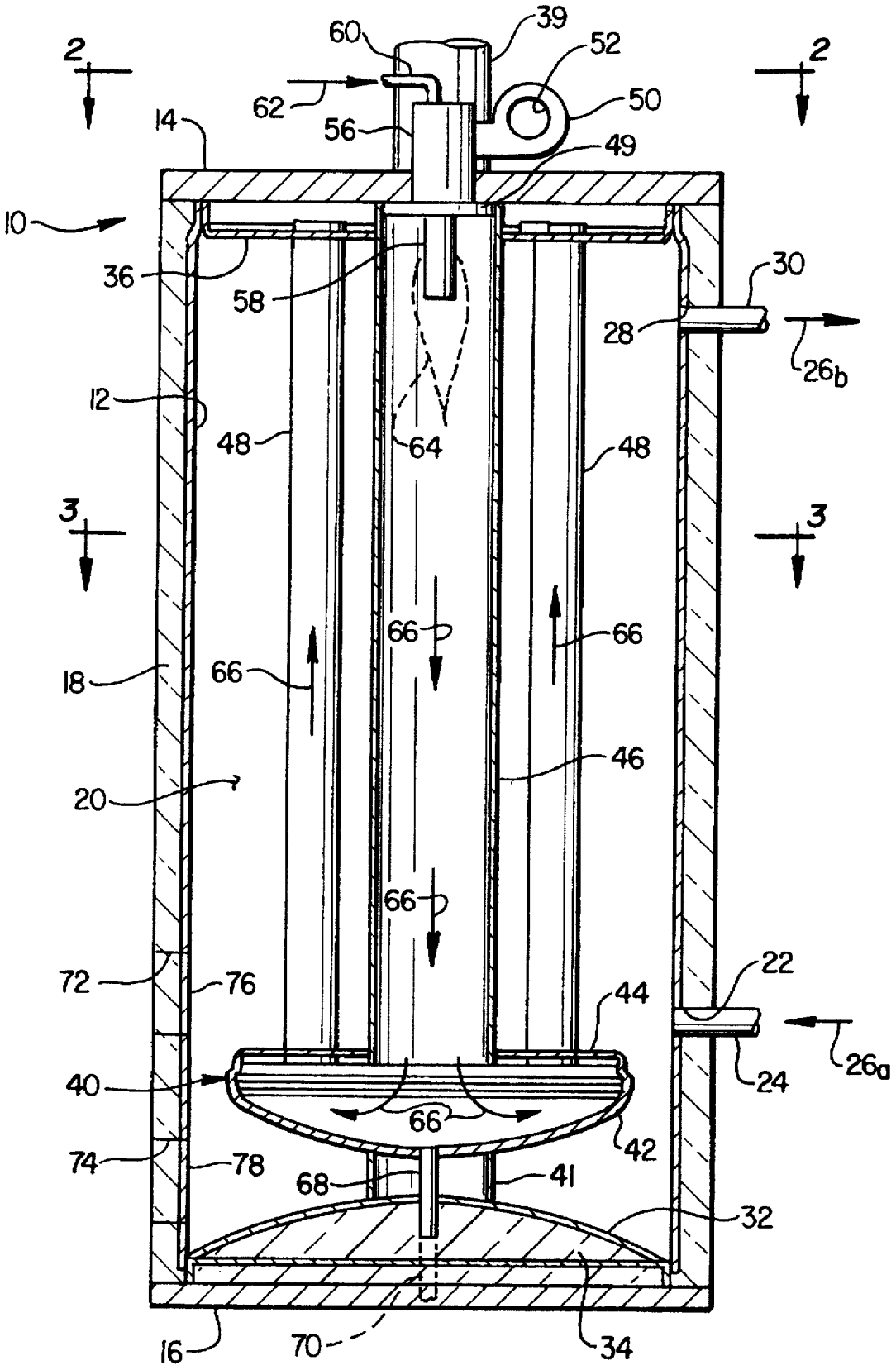
FIG. 1 is a simplified, horizontally directed, partially schematic cross-sectional view through an improved wet-base, down-fired water heater embodying principles of the present invention.
Figure 2:
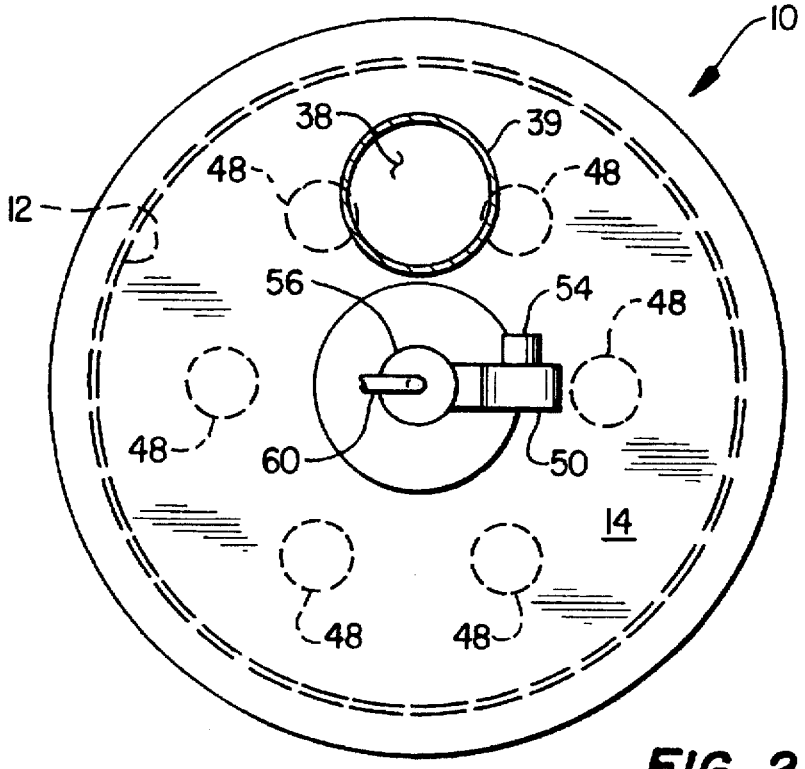
FIG. 2 is an enlarged scale top plan view of the water heater taken along line 2—2 of FIG. 1.
Figure 3:
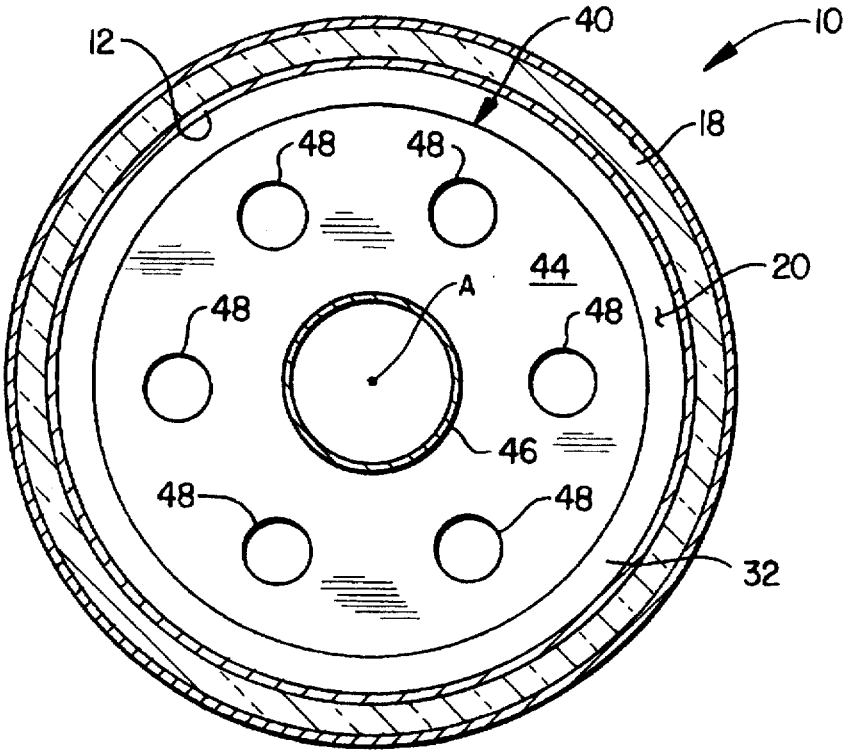
FIG. 3 is an enlarged scale cross-sectional view through the water heater taken along line 3—3 of FIG. 1.

Illustrated in FIGS. 1–3 is a fuel-fired forced draft water heater 10 embodying principles of the present invention and having a unique wet-base, down-fired construction as later described. With the important exceptions noted below, the water heater 10 is similar to the down-fired water heater illustrated and described in U.S. Pat. No. 5,197,415 which is hereby incorporated by reference herein.

Water heater 10 includes a vertically oriented cylindrical metal tank 12 having a metal top pan 14, a metal bottom pan 16, an external insulation jacket 18, and an internal chamber 20 filled with water to be heated and stored within the tank. A lower end portion of the tank 12 is provided with an inlet opening 22 to which an inlet pipe 24 may be connected to flow pressurized water **26*a* into the tank to be heated therein as subsequently described. An upper end portion of the tank 12 is provided with an outlet opening 28 to which a supply pipe 30 may be connected to discharge heated water 26*b*** from the tank on demand.

Disposed within a lower end portion of the tank 12 is a hollow bottom head structure 32, filled with insulation material 34, that defines the lower end boundary of the water filled internal chamber 20. A vent plenum structure 36 is formed within an upper end portion of the tank 12, along the underside of the top pan 14, and has an outlet passage 38 (see FIG. 2) that may be connected to an external combustion product vent pipe 39. For purposes later described, a hollow metal turn bowl structure 40, submerged within the water in the internal tank chamber 20, is supported on the top side of the bottom head structure 32, in an upwardly spaced relationship therewith, by a hollow tubular support column 41. The turn bowl 40 has a generally circular shape, a diameter somewhat smaller than that of the tank, a downwardly curved bottom wall 42, and a generally flat top wall 44.

Also submerged within the internal tank chamber 20, and in intimate heat transfer contact with the water therein, are a vertically oriented burner tube 46 and a spaced series of six vertically oriented, smaller diameter flue tubes 48. As best illustrated in FIG. 3, and in accordance with a key aspect of the present invention, the arrangement of the vertically oriented burner tube 46 and its six associated flue tubes 48 is symmetrical about the central vertical axis A of the water storage tank 12. More specifically, the burner tube 46 is centered on the axis A (as is the underlying turn bowl 40), and the six associated flue tubes 48 are circumferentially spaced equally around the burner tube 46 at equal radial distances outwardly therefrom.

The closed upper end 49 of the burner tube 46 extends upwardly through the bottom wall of the vent plenum structure 36, and the open lower end of the burner tube extends downwardly through the top side wall 44 of the turn bowl 40 into the interior of the turn bowl and is spaced upwardly apart from the curved bottom turn bowl wall 42. The open upper and lower ends of the flue tubes 48 respectively extend short distances through the bottom wall of the vent plenum structure 36 and the top side wall 44 of the turn bowl 40. The interiors of the vent plenum structure and the turn bowl are thus communicated through the six flue tubes 48.

Externally mounted on the top pan 14 is a forced draft combustion air blower 50 having an air inlet 52, an electric drive motor 54 (see FIG. 2), and an outlet pipe 56 connected to the upper end of a schematically depicted fuel burner structure 58 (representatively a gas burner, but which could be a burner which utilizes another type of fuel) extending downwardly through an upper end portion of the burner tube 46. A suitably valved gas inlet pipe 60 is connected to the outlet pipe 56 to deliver into the outlet pipe a gaseous fuel for mixture therein with combustion air supplied to the interior of the outlet pipe 56 by the blower 50.

During firing of the water heater 10, as called for by a thermostat (not shown), combustion air from the blower 50 and gaseous fuel 62 flowing inwardly through the gas inlet pipe 60 are flowed into the outlet pipe 56 to form therein a fuel/air mixture that is forced downwardly through the burner 58. The pressurized fuel/air mixture is then forced outwardly through the burner 58 and ignited to create within an upper end portion of the burner tube 46 a burner flame 64.

Flame 64, in turn, creates hot combustion gases 66 that are sequentially forced downwardly through the lower end of the burner tube 46 into the submerged turn bowl 40, upwardly through the vertical flue tubes 48 into the interior of the vent plenum structure 36, and then into the combustion product vent pipe 39 through the vent plenum outlet passage 38. Combustion heat is thus very efficiently transferred to the water within the internal tank chamber 20 via the centrally positioned burner tube 46, the turn bowl 40, and the symmetrically arranged vertical flue tubes 48 grouped around the central burner tube 46.

With reference now to FIG. 1, the improved wet-base, down-fired water heater 10 of the present invention is also provided with a condensate drain tube 68 which centrally extends downwardly from the bottom turn bowl side wall 42 through the interior of the support column 41 into the interior of the bottom head structure 32. The tube 68 has open upper and lower ends, communicates with the interior of the turn bowl 40, and is used to drain away condensed moisture within the interior of the turn bowl. To facilitate this condensate drainage, a suitable tube extension 70 may be connected to the lower end of the tube 68 and routed to a suitable receptacle such as a floor drain (not shown).

Water scale forming on the exterior side surfaces of the burner and flue tubes 46,48 periodically falls to a bottom portion of the tank and comes to rest on the top sides of the turn bowl 40 and the bottom head 32. Convenient removal of this loosened scale from the top sides of the turn bowl and the bottom head structure is facilitated through upper and lower handholes 72,74 formed through the tank side wall and respectively being vertically adjacent the top side of the turn bowl 40 and the top side of the bottom head structure 32. The handholes 72,74 are normally covered by removable, gasketed cover plates 76,78.

The improved down-fired water heater 10 of the present invention provides a variety of structural and operational advantages over the previously proposed down-fired water heater illustrated and described in U.S. Pat. No. 5,197,415. For example, and quite importantly, the symmetrical heat transfer apparatus configuration in the improved water heater 10 of the present invention results in markedly higher fuel efficiency and provides (for the same firing input rate and the same 6" I.D. burner tube) essentially the same water heating capacity with only six 2.5" I.D. flue tubes instead of the eight 2.5" I.D. flue tubes in the water heater illustrated and described in U.S. Pat. No. 5,197,415. This represents a very substantial 25 percent reduction in the flue area-to-burner tube area ratio in the improved water heater 10 of the present invention. Not only does the symmetrical heat transfer apparatus configuration result in markedly higher fuel efficiency in the down-fired water heater 10 of the present invention, but it also advantageously equalizes thermal stresses in and heat transfer from the flue tubes.

The above-noted reduction in the number of vertical flue tubes for a given input firing rate allows not only a cost reduction in the finished water heater, but also makes the operation of the combustion product vent plenum 36 more effective from a flow equalization standpoint. Accordingly, even if the outlet passage 38 (see FIG. 2) is positioned directly over the open upper end of one of the flue tubes 48, little if any short circuiting of the exhaust flow within the plenum 36 occurs.

Another primary benefit arising from the symmetrical arrangement of the burner and flue tubes 46,48 is that due to the resulting substantial increase in the fuel efficiency of the water heater 10 the burner 58 does not have to be of the special vertically elongated conical configuration illustrated and described in U.S. Pat. No. 5,197,415. Instead, it can be of another suitable, more conventional and less costly design. Representatively, the burner 58 has been shown in FIG. 1 as being of a hollow tubular configuration adapted to downwardly inject the flame 64 from a lower end portion thereof.

The centered location of the burner tube 46 allows for easier manufacturing and reduced processing of the water heater's heat transfer apparatus. In addition, the structural loading in the present invention's symmetrical design is considerably more efficient at handling the pressure loading of its components. Moreover, the weight load of the tubes 46,48 is evenly imposed on the turn bowl 40, and thus the support column 41 and the bottom head structure 32. Moreover, the centered burner tube 46 allows for ease of inspection and repair of the burner system.

The turn bowl structure 40 is also enhanced by the symmetrical configuration of the heat transfer apparatus in the improved water heater 10 of the present invention, the turn bowl structure being correspondingly easier to manufacture. With the centered burner tube 46 the turn bowl area can more efficiently transfer heat to the water within the tank 12. As a result, scale is less likely to form in these areas, especially since the majority of the turn bowl area is surrounded by water. Long-term, this reduces the impact of high temperatures on the base material, resulting in longer life.

In summary, compared to the down-fired water heater illustrated and described in U.S. Pat. No. 5,197,415, all of these enhancements result in a more economical and durable product. Specifically, in the improved water heater 10 of the present invention, the uniformity of heat distribution is enhanced, the fuel efficiency is increased, the durability of the water heater is greater, scaling is reduced, less anode protection is needed, and NOx emission levels are even further diminished.

The foregoing detailed description is to be clearly understood as being given by way of illustration and example only, the spirit and scope of the present invention being limited solely by the appended claims.

What is claimed is:

1. A forced draft, fuel-fired water heater comprising:

a vertical tank centered about a vertical axis and having an internal chamber adapted to hold a quantity of water, said tank having a top end, a bottom end, an inlet for receiving pressurized water to be heated within said internal chamber, and an outlet for discharging pressurized heated water from said internal chamber;

a vent plenum structure formed within a top end portion of said tank, downwardly adjacent the underside of said top end thereof, and defining a top end boundary of said internal chamber, said vent plenum structure having an outlet passage extending outwardly through said tank and connectable to an external combustion product vent pipe;

an enclosed, hollow turn bowl structure disposed within a lower end portion of said internal chamber, said hollow turn bowl structure being centered about said vertical axis and having a top side wall and a bottom side wall;

a vertically oriented burner tube extending through said internal chamber along said vertical axis, said burner tube having an upper end positioned adjacent said top end of said tank, and a lower end portion extending downwardly through said top side wall of said turn bowl structure and opening into the interior of said turn bowl structure;

a plurality of vertically oriented flue tubes extending through said internal chamber in a symmetrically spaced array extending outwardly around and centered about said burner tube, said flue tubes having open upper end portions extending through the underside of said vent plenum structure and opening into the interior of said vent plenum structure, and open lower end portions extending through said top side wall of said turn bowl structure and opening into the interior of said turn bowl structure, each of said flue tubes, said burner tube and said turn bowl structure, during operation of said water heater, being submerged in and in intimate heat transfer contact with water within said internal chamber of said tank;

burner means extending downwardly through an upper end portion of said burner tube and being operative to receive a pressurized fuel/air mixture from a source thereof, and ignite the received fuel/air mixture to form hot combustion products which are sequentially flowed downwardly through said burner tube into said turn bowl structure, upwardly through said flue tubes into said vent plenum structure, and then outwardly through said outlet passage of said vent plenum structure; and fuel/air delivery means operative to flow a pressurized fuel/air mixture to said burner means, said bottom end of said tank being defined by an upwardly domed bottom head structure, said turn bowl structure being supported atop said bottom head structure by a vertically oriented hollow cylindrical support column centered about said axis, and said water heater further comprising a condensate drain tube centrally extending downwardly from said turn bowl structure through the interior of said support column into said bottom heat structure and having an interior communicating with the interior of said hollow turn bowl structure.

2. The water heater of claim 1 wherein:

said flue tubes are arranged in a circular array outwardly around said burner tube.

3. The water of claim 2 wherein:

the circumferential spacing between each circumferentially successive pair of said flue tubes is constant.

4. The water heater of claim 1 wherein:

said burner means include a gas burner.

5. The water heater of claim 1 wherein:

said bottom end of said tank is defined by an upwardly domed bottom head structure, said turn bowl structure is supported atop said bottom head structure by a vertically oriented hollow cylindrical support column centered about said axis, and said water heater further comprises sealed first and second handhole access openings extending horizontally through said tank and respectively positioned vertically adjacent the top side of said turn bowl structure and the top side of said bottom head structure.

* * * * *